US012048405B2

(12) United States Patent
Büsing et al.

(10) Patent No.: US 12,048,405 B2
(45) Date of Patent: Jul. 30, 2024

(54) DISHWASHER

(71) Applicant: SAMSUNG ELECTRONICS CO., LTD., Suwon-si (KR)

(72) Inventors: Johannes Büsing, Suwon-si (KR); Jisun Yang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 119 days.

(21) Appl. No.: 17/950,743

(22) Filed: Sep. 22, 2022

(65) Prior Publication Data

US 2023/0157514 A1 May 25, 2023

Related U.S. Application Data

(63) Continuation of application No. PCT/KR2022/012950, filed on Aug. 30, 2022.

(30) Foreign Application Priority Data

Nov. 25, 2021 (KR) ..... 10-2021-0164530

(51) Int. Cl.
*A47L 15/22* (2006.01)
*A47L 15/42* (2006.01)

(52) U.S. Cl.
CPC ..... *A47L 15/22* (2013.01); *A47L 15/421* (2013.01); *A47L 15/4225* (2013.01); *A47L 15/4278* (2013.01)

(58) Field of Classification Search
None
See application file for complete search history.

(56) References Cited

U.S. PATENT DOCUMENTS 10,631,706 B2 4/2020 Bürkle et al.
2017/0231461 A1* 8/2017 Bürkle ..... A47L 15/23 239/463

FOREIGN PATENT DOCUMENTS

| | | | |
|---|---|---|---|
| CN | 106955081 | A | 7/2017 |
| CN | 208973765 | U | 6/2019 |
| CN | 209048065 | U | 7/2019 |
| CN | 111035343 | A | 4/2020 |
| CN | 107205610 | B | 11/2020 |

(Continued)

OTHER PUBLICATIONS

International Search Report dated Dec. 28, 2022 issued in PCT Application No. PCT/KR2022/012950.

(Continued)

*Primary Examiner* — Levon J Shahinian
(74) *Attorney, Agent, or Firm* — STAAS & HALSEY LLP

(57) ABSTRACT

A dishwasher includes a tub, a basket, a spray device configured to spray washing water, and a sump configured to supply the washing water to the spray device. The spray device includes a first spray rotor including a first spray arm and a shaft integrally formed with the first spray arm to guide the washing water supplied from the sump to the first spray arm, a second spray rotor rotatably coupled to the shaft and including a second spray arm configured to spray the washing water branched from the washing water guided to the first spray arm through the shaft, and a shaft hole formed in the second spray arm to allow the shaft to pass therethrough, and a communication hole formed in the shaft to allow the shaft to communicate with the second spray arm.

21 Claims, 10 Drawing Sheets

(56) References Cited

FOREIGN PATENT DOCUMENTS

| | | | |
|---|---|---|---|
| EP | 3 845 110 | A1 | 7/2021 |
| JP | 4653346 | B2 | 3/2011 |
| KR | 1994-0010993 | | 11/1994 |
| KR | 1998-054358 | A | 9/1998 |
| KR | 20-0341841 | Y1 | 2/2004 |
| KR | 10-1138883 | | 5/2012 |
| KR | 10-1183515 | B1 | 9/2012 |
| KR | 10-2021-0136745 | | 11/2021 |
| WO | WO 2020/042750 | A1 | 3/2020 |

OTHER PUBLICATIONS

Written Opinion dated Dec. 28, 2022 issued in PCT Application No. PCT/KR2022/012950.

* cited by examiner

DISHWASHER

CROSS-REFERENCE TO RELATED APPLICATION(S)

This application is a continuation application, under 35 U.S.C. § 111(a), of international application No. PCT/KR2022/012950, filed on Aug. 30, 2022, which claims priority to Korean Patent Application No. 10-2021-0164530, filed on Nov. 25, 2021, in the Korean Intellectual Property Office, the disclosure of which is incorporated by reference herein in its entirety

BACKGROUND

1. Field

The disclosure relates to a dishwasher including a spray device including an improved structure.

2. Description of Related Art

In general, a dishwasher is a device for washing and drying dishes by spraying washing water at a high pressure. The dishwasher is operated in such a way that washing water is sprayed at high pressure into a washing chamber in which dishes are stored, and the sprayed washing water comes into contact with the dishes to wash foreign substances such as food waste on a surface of the dishes.

The dishwasher may include a main body, a tub arranged inside the main body, a sump in which washing water is stored, a storage container arranged inside the tub to accommodate dishes, and a spray device configured to spray the washing water into the storage container.

For example, the spray device of the dishwasher may be provided with a plurality of rotors. In this case, due to the structure in which the plurality of rotors is coupled, foreign substances such as food waste may be caught between the rotors, and the rotors may be shaken during rotation because a fixation thereof is not easy. In addition, a flow loss may occur while the washing water pumped from the sump is introduced into the plurality of rotors.

SUMMARY

Therefore, it is an aspect of the disclosure to provide a dishwasher including a spray device including an improved structure.

Additional aspects of the disclosure will be set forth in part in the description which follows and, in part, will be obvious from the description, or may be learned by practice of the disclosure.

In accordance with an aspect of the disclosure a dishwasher includes a tub, a basket inside the tub to accommodate an object to wash, a spray device configured to spray washing water to wash the object accommodated in the basket, and a sump configured to supply the washing water stored therein to the spray device. The spray device includes a first spray rotor including a first spray arm configured to spray the washing water and a shaft integrally formed with the first spray arm to guide the washing water supplied from the sump, to the first spray arm therethrough, a second spray rotor rotatably coupled to the shaft, the second spray rotor including a second spray arm configured to spray washing water branched from the washing water which is guided to the first spray arm through the shaft, and a shaft hole formed in the second spray arm to allow the shaft to pass therethrough, and a communication hole formed in the shaft to allow the shaft to communicate with the second spray arm so that a portion of washing water, which is guided to the first spray arm, to flow into the second spray arm.

The dishwasher may further include a holder coupled to an outer peripheral surface of the shaft to support the second spray rotor.

The second spray rotor may further include a rotation guide formed in the shaft hole to reduce friction with the shaft, and the rotation guide comprising a plurality of guide protrusions protruding toward a center of the shaft hole and to be in contact with an outer peripheral surface of the shaft when the shaft is inserted into the shaft hole, the plurality of guide protrusions being spaced apart from each other along a peripheral direction of the shaft hole.

The second spray arm may further include an upper body and a lower body coupled to a lower side of the upper body to form a flow path through which the washing water flows. The shaft hole may further include a first shaft hole formed in the upper body and a second shaft hole formed in the lower body. The rotation guide may further include a first rotation guide formed in the first shaft hole and a second rotation guide formed in the second shaft hole and vertically spaced apart from the first rotation guide.

The dishwasher may further include a supporting tube provided to support the outer peripheral surface of the shaft and formed such that one end of the supporting tube is connected to the holder and the other end of the supporting tube is connected to the sump.

The shaft and the holder may be inserted into the supporting tube. The shaft may include a first support protrusion protruding to be in contact with an inner peripheral surface of the supporting tube. The holder may include a second support protrusion protruding to be in contact with the inner peripheral surface of the supporting tube and vertically spaced apart from the first support protrusion.

The first spray rotor may further include at least one first sealing protrusion protruding toward the second spray arm of the second spray rotor and at least one first sealing groove adjacent to the at least one first sealing protrusion. The second spray rotor may further include at least one second sealing protrusion protruding toward the first spray arm of the first spray rotor and at least one second sealing groove adjacent to the at least one second sealing protrusion. When the first spray rotor is coupled to the second spray rotor, the at least one first sealing protrusion may be inserted into the at least one second sealing groove corresponding to the at least one first sealing protrusion. The second spray rotor may further include at least one third sealing protrusion protruding toward the holder. The holder may further include at least one fourth sealing protrusion protruding toward the second spray rotor and alternately arranged with the at least one third sealing protrusion with respect to the radial direction.

Each of the second sealing protrusion and the third sealing protrusion of the second spray rotor may be a ring shaped. An outermost diameter of the second sealing protrusion may be greater than an outermost diameter of the third sealing protrusion, and a protruding length of the second sealing protrusion may be greater than a protruding length of the third sealing protrusion.

The first spray rotor may further include a curved member formed to be curved between the shaft and the first spray arm to reduce a pressure loss of the washing water guided to the first spray arm through the shaft.

The holder may further include a hook protruding toward the shaft, and the shaft may further include a hook groove to be engaged with the hook.

The supporting tube may further include a flange bent outward in a radial direction from the one end of the supporting tube, and the holder may further include a flange hook protruding radially inward toward the flange to be engaged with the flange of the supporting tube.

The first spray rotor and the second spray rotor may be formed of a material different from a material of the holder to reduce friction with the holder.

The shaft may include a truncated cone shape in which a diameter of the shaft is reduced as a distance from the first spray arm is increased.

Each of the first spray arm and the second spray arm may extend in a direction perpendicular to an extension direction of the shaft, and an extension length of the first spray arm may be greater than an extension length of the second spray arm. The first spray arm may include a plurality of first nozzles along a longitudinal direction of the first spray arm, and the second spray arm may include a plurality of second nozzles along a longitudinal direction of the second spray arm. A number of the plurality of first nozzles may be greater than a number of the plurality of second nozzles.

The at least one first sealing protrusion and the at least one first sealing groove may be alternatively formed in a radial direction, and the at least one second sealing protrusion and the at least one second sealing groove may be alternatively formed in the radial direction.

In accordance with another aspect of the disclosure a dishwasher includes a tub forming a washing chamber, a first spray arm to be rotated in a first direction to spray washing water to the washing chamber, a shaft integrally formed with the first spray arm to extend downwardly from the first spray arm and to guide the washing water to the first spray arm, a second spray arm on a lower side of the first spray arm and to be rotated in a second direction to spray the washing water to the washing chamber, a shaft hole formed in the second spray arm and to allow the shaft to penetrate through the second spray arm so that the second spray arm is rotatably coupled to an outer peripheral surface of the shaft, a pair of sealing members between the first spray arm and the second spray arm to prevent a leakage of the washing water, the pair of sealing members including a first sealing member formed on a lower side of the first spray arm and a second sealing member formed in an upper side of the second spray arm to correspond to the first sealing member, and a pair of rotation guides in the shaft hole to guide a rotation of the second spray arm and the shaft, the pair of rotation guides including a first rotation guide and a second rotation guide vertically spaced part from the first rotation guide.

The dishwasher may further include a ring-shaped holder on a lower side of the second spray arm and coupled to the outer peripheral surface of the shaft to support the second spray arm.

The dishwasher may further include a communication hole formed in the shaft to allow a portion of the washing water, which is guided by the shaft, to branch into the second spray arm.

In accordance with another aspect of the disclosure a dishwasher includes a tub forming a washing chamber, a sump to store washing water in the washing chamber, and a spray device in a lower portion of the tub to spray the washing water to an inside of the washing chamber. The spray device may include a shaft to guide the washing water introduced from the sump, the shaft having a truncated cone shaped in which a diameter thereof is increased as a distance to an upper portion is reduced, a first spray blade integrally extending from an upper end of the shaft to form a first flow path into which a portion of the washing water guided by the shaft is introduced, a second spray blade coupled to a lower side of the first spray blade and an outer peripheral surface of the shaft, and to form a second flow path into which a remaining portion of the washing water guided by the shaft is introduced, a holder on a lower side of the second spray blade to be coupled to the outer peripheral surface of the shaft to support the second spray blade, and a supporting tube into which the shaft and the holder are inserted to support the shaft.

The shaft may further include a communication hole formed therein to communicate with the second flow path of the second spray blade.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
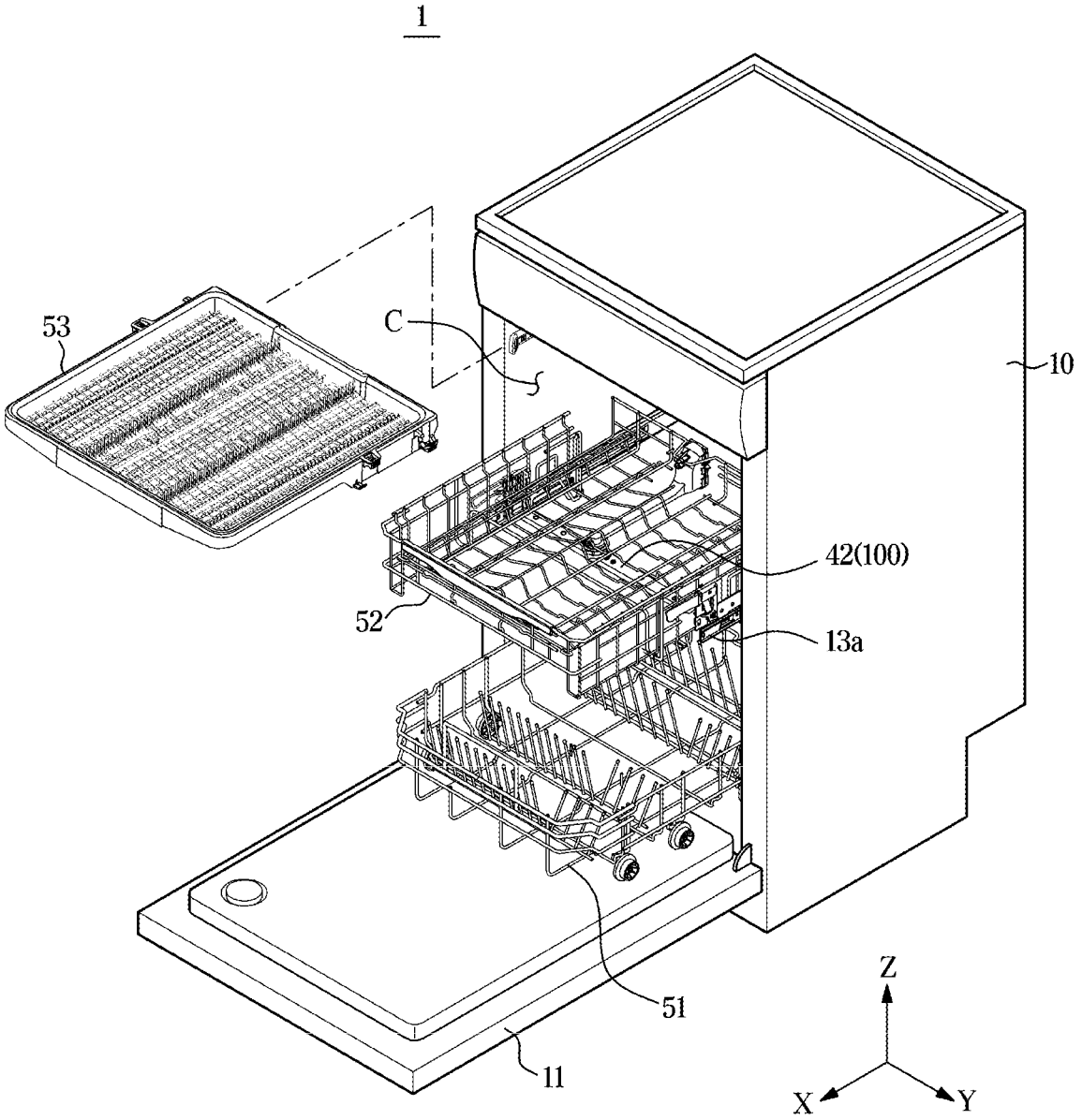
FIG. 1 is a schematic perspective view illustrating a dishwasher according to an embodiment of the disclosure.

Embodiments described in the disclosure and configurations illustrated in the drawings are merely examples of the embodiments of the disclosure, and may be modified in various different ways at the time of filing of the present application to replace the embodiments and drawings of the disclosure.

In addition, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that when an element is referred to as being "connected" another element, it can be directly or indirectly connected to the other element. Similarly, it will be understood that when an element is referred to as being "coupled" another element, it can be directly or indirectly coupled to the other element.

Throughout the description, when a member is "on" another member, this includes not only when the member is in contact with the other member, but also when there is another member between the two members.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

The terms of "front and rear", "front", "rear", "upper", "lower", "vertical direction", "height direction", etc. used in the following description are defined based on the drawings, but the shape and the location of the component is not limited by the term. For example, as shown in FIG. 1, a direction in which a door 20 faces in a dishwasher 1 may be defined as a front side (+X direction), and the opposite direction may be defined as a rear side (−X direction). A direction in which a plurality of baskets is arranged in the dishwasher 1 may be defined as a vertical direction or a height direction (Z direction).

Hereinafter an embodiment according to the disclosure will be described in detail with reference to the accompanying drawings.

Figure 2:
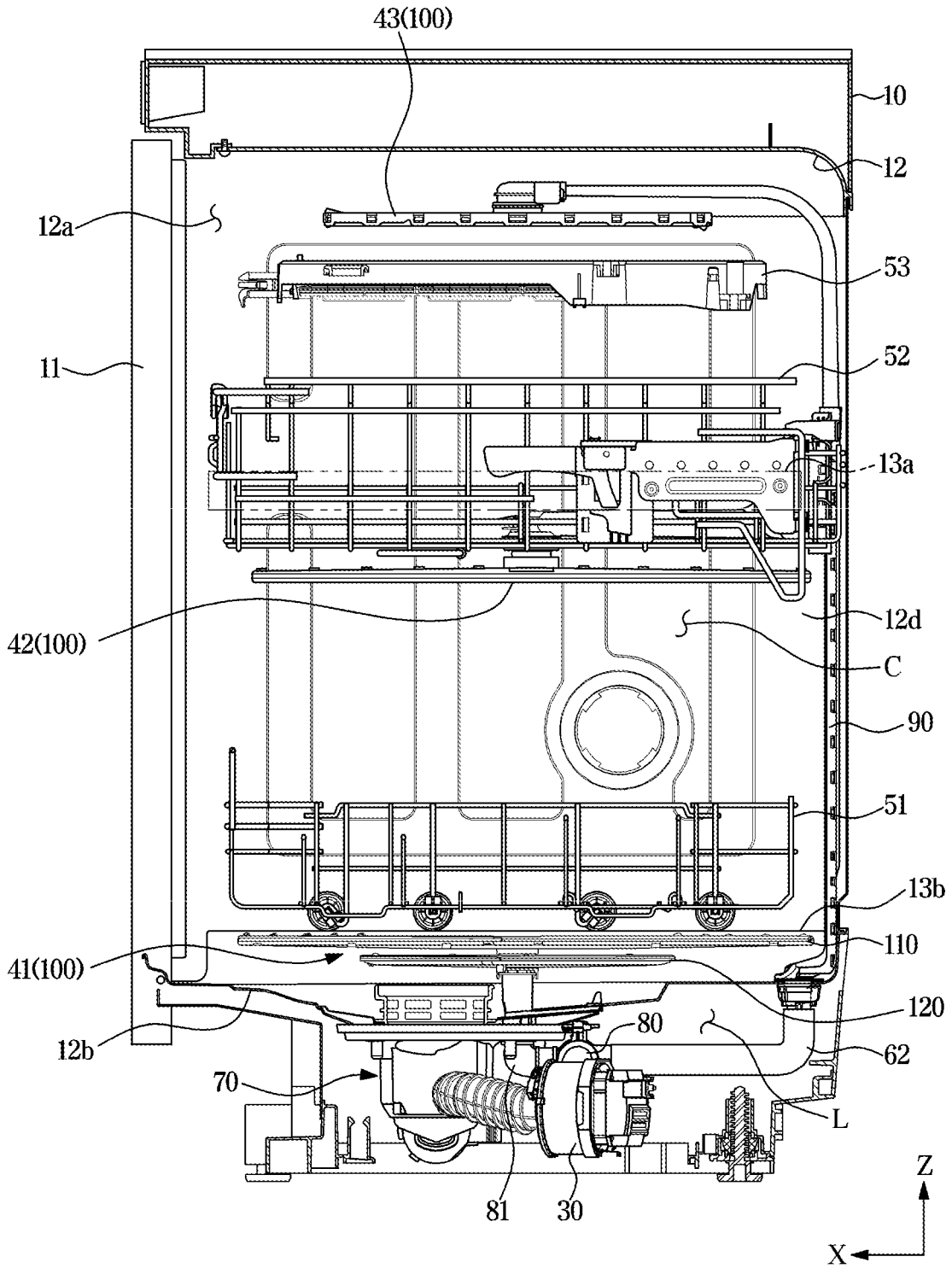
FIG. 2 is a schematic side view illustrating the dishwasher according to an embodiment of the disclosure.

FIG. 1 is a schematic perspective view illustrating a dishwasher according to an embodiment of the disclosure. FIG. 2 is a schematic side view illustrating the dishwasher according to an embodiment of the disclosure.

Referring to FIGS. 1 and 2, the dishwasher 1 may include a main body 10. The main body 10 may form an appearance thereof.

The dishwasher 1 may include a tub 12 arranged inside the main body 10. The tub 12 may be formed in a substantially box shape. One side of the tub 12 may be openable. That is, the tub 12 may include an opening 12*a*. As an example, a front surface of the tub 12 may be openable.

The dishwasher 1 may include a door 11 configured to open and close the opening 12*a* of the tub 12. The door 11 may be installed in the main body 10 to open and close the opening 12*a* of the tub 12. The door 11 may be rotatably installed in the main body 10. The door 11 may be removably mounted to the main body 10.

The dishwasher 1 may further include a storage container arranged in the tub 12 to accommodate dishes.

The storage container may include a plurality of baskets 51, 52 and 53. Relatively large dishes may be stored in the plurality of baskets 51, 52, and 53. However, the kind of dishes accommodated in the plurality of baskets 51, 52, and 53 is not limited to relatively large dishes. That is, the plurality of baskets 51, 52 and 53 may accommodate not only relatively large dishes but also relatively small dishes.

The storage container may include an intermediate basket 52 positioned in the middle with respect to the height direction of the dishwasher 1, and a lower basket 51 positioned in a lower portion with respect to the height direction of the dishwasher 1. The intermediate basket 52 may be provided to be supported by an intermediate guide rack 13*a*, and the lower basket 51 may be provided to be supported by a lower guide rack 13*b*. The intermediate guide rack 13*a* and the lower guide rack 13*b* may be installed on a side surface 12*d* of the tub 12 so as to be slidable toward the opening 12*a* of the tub 12. Particularly, the intermediate guide rack 13*a* and the lower guide rack 13*b* may be installed on an inner surface of the side surface 12*d* of the tub 12.

The storage container may include an upper basket 53 positioned in an upper portion with respect to the height direction of the dishwasher 1. The upper basket 53 may be formed in a rack assembly to accommodate relatively small dishes. It is appropriate that the upper basket 53 may contain a cooking utensil such as a ladle, a knife, or a turner, or cutlery. In addition, the rack assembly may accommodate a small cup such as an espresso cup. However, the kind of dishes accommodated in the upper basket 53 is not limited to the above example.

In addition, the shape of the storage container is not limited to the shape shown in FIGS. 1 and 2. For example, the upper basket 53 may not be included according to the size of the tub 12. Therefore, the storage container may be implemented only with the intermediate basket 52 and the lower basket 51.

The dishwasher 1 may include a washing chamber C formed inside the tub 12.

The washing chamber C may be defined as an inner space of the tub 12.

The dishwasher 1 may include a sump 70 configured to store washing water. The sump 70 may be configured to collect washing water and pump the washing water. For example, a lower surface 12*b* of the tub 12 may be inclined toward the sump 70 to allow the sump 70 to easily collect washing water, and the washing water flowing along the lower surface 12*b* of the tub 12 may be collected in the sump 70.

The sump 70 may be configured to supply the pumped washing water to the tub 12. For example, the sump 70 may include a washing pump (also referred to as a circulation pump) 30 configured to pump washing water, and a pump motor (not shown) configured to drive the washing pump 30. Further, the sump 70 may be arranged below the tub 12 to easily collect the washing water.

The dishwasher 1 may include a spray device 100 configured to spray washing water.

The spray device 100 may include a plurality of spray devices 41, 42, and 43. The plurality of spray devices 41, 42, and 43 may include a first spray device 41 arranged below the lower basket 51 in the height direction of the dishwasher 1, a second spray device 42 arranged below the intermediate basket 52 in the height direction of the dishwasher 1, and a third spray device 43 arranged above the upper basket 53 in the height direction of the dishwasher 1.

The first spray device 41, the second spray device 42, and the third spray device 43 may be configured to spray washing water while rotating.

However, the spray devices 41, 42 and 43 may spray washing water in a method different from the above-mentioned example. For example, the first spray device 41 may be fixed to one side of the lower surface 12*b* unlike the second spray device 42 and the third spray device 43. In this case, the first spray device 41 may be configured to spray washing water in a substantially horizontal direction by a fixed nozzle, and the washing water sprayed in the horizontal direction from the nozzle of the first spray device 41 may be directed to the upper side because a direction of the sprayed water is changed by a switching assembly. The switching assembly may be installed on a rail by a holder and translated along the rail.

The third spray device 43 may spray the washing water toward the dishes stored in the upper basket 53, the intermediate basket 52, and the lower basket 51. The second spray device 42 may spray the washing water toward the dishes stored in the intermediate basket 52 and the upper basket 53.

The first spray device 41 may be arranged in a lower portion of the washing chamber C. For example, the first spray device 41 may be arranged on the lower surface 12*b* of the tub 12. The first spray device 41 may be connected to the sump 70.

The dishwasher 1 may include a circulation pump 30 configured to pump water stored in the sump 70 toward the spray device 100. The washing water pumped by the circulation pump 30 may be supplied to the first spray device 41 through an alternating device 80 connected to the circulation pump 30. Alternatively, the washing water pumped by the circulation pump 30 may be moved upward by a duct 90 and then supplied to the second spray device 42 or the third spray device 43.

The washing water stored in the sump 70 or washing water introduced into the dishwasher 1 from the outside may flow to the alternating device 80 by the circulation pump 30.

The alternating device 80 may supply the washing water to the first spray device 41 through a connector 81 connected to the first spray device 41, and may supply the washing water to the duct 90 through a flow path 62 connected to the duct 90. The alternating device 80 may supply the washing water to at least one of the connector 81 and the duct 90.

The dishwasher 1 may include a machine room L arranged below the tub 12. A configuration for circulating washing water may be arranged in the machine room L.

For example, at least a part of the connector 81, and the flow path 62 may be arranged in the machine room L arranged below the washing chamber C. That is, at least a part of the connector 81 and the flow path 62 may be arranged lower than the lower surface 12*b* of the tub 12 with respect to the height direction of the dishwasher 1.

Through the connector 81 and the flow path 62, the washing water may flow to the first spray device 41 and the duct 90 arranged inside the washing chamber C. The washing water may flow to the second spray device 42 and the third spray device 43 through the duct 90.

The above-described circulation pump 30, and sump 70, and alternating device 80 may be arranged in the machine room L and further a water supply hose (not shown) and a drain hose (not shown) may be arranged in the machine room L.

A capacity of the washing chamber C may be increased or decreased according to a height of the machine room L. As the height of the machine room L is reduced, the height of the washing chamber C may be increased. That is, in order to secure the capacity of the washing chamber C, it is required to reduce the height of the machine room L by arranging the components arranged in the machine room L compactly.

Figure 3:
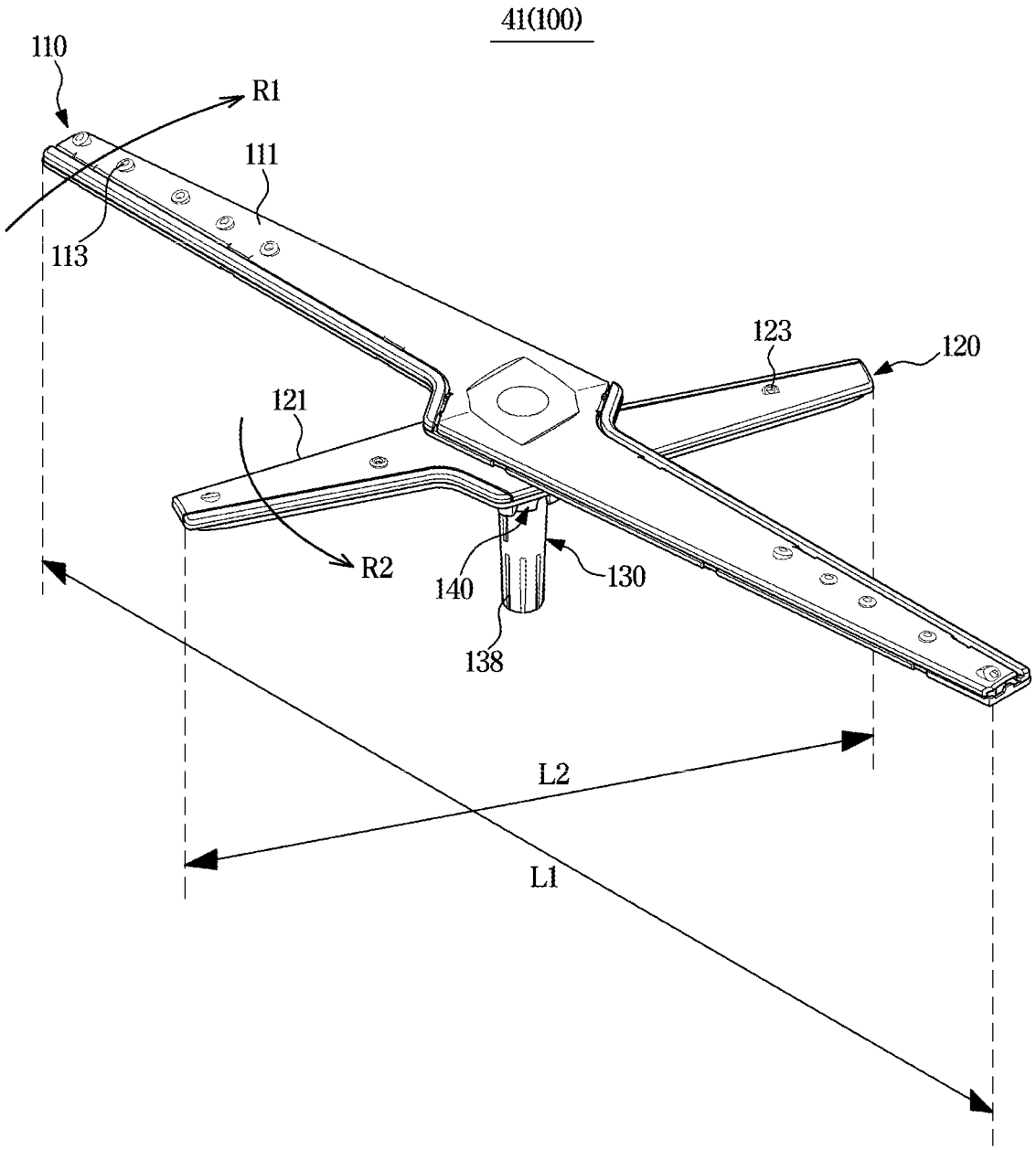
FIG. 3 is a perspective view illustrating an example of a spray device of the dishwasher according to an embodiment of the disclosure.
Figure 4:
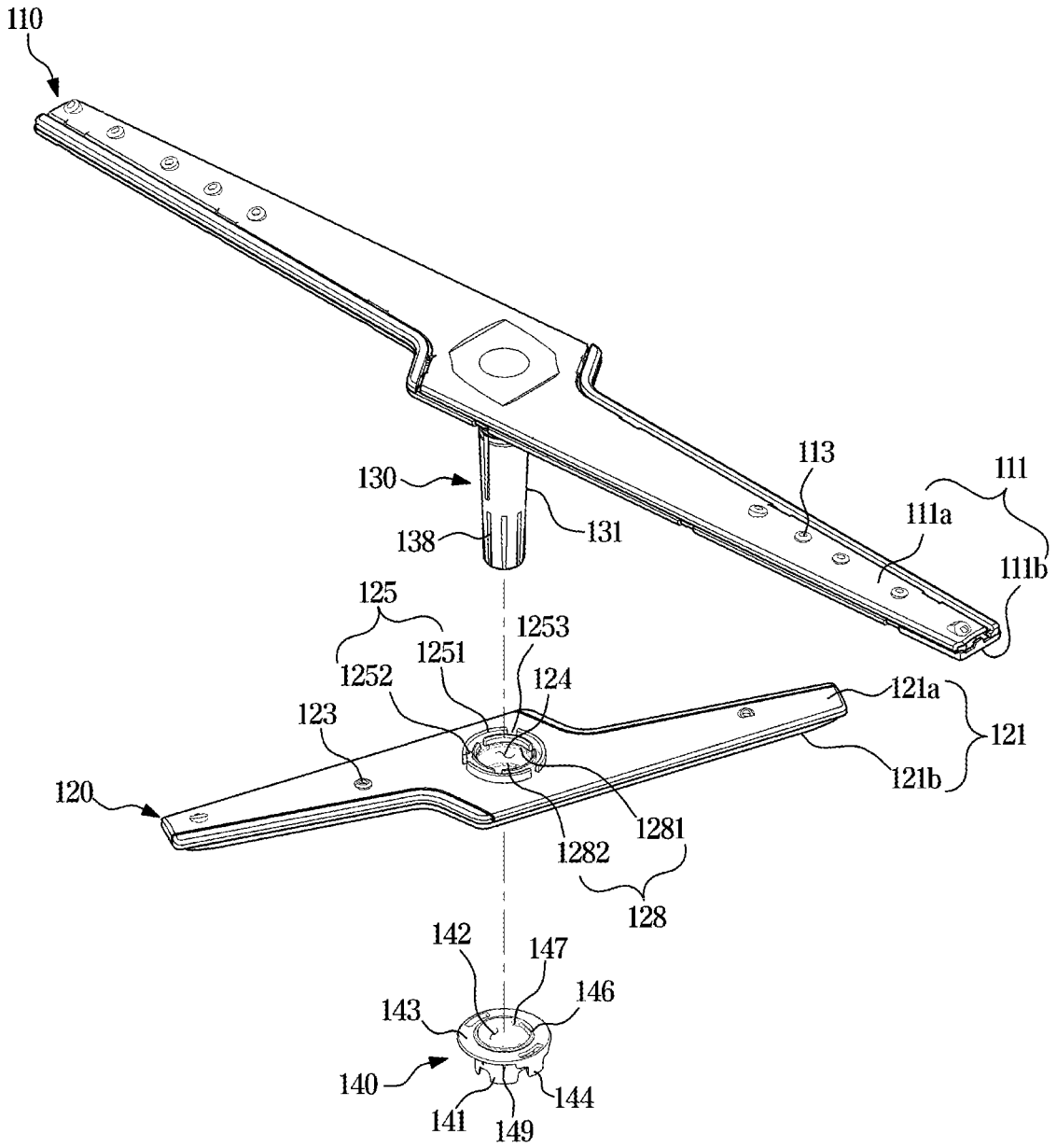
FIG. 4 is an exploded view illustrating an example of the spray device of the dishwasher according to an embodiment of the disclosure.
Figure 5:
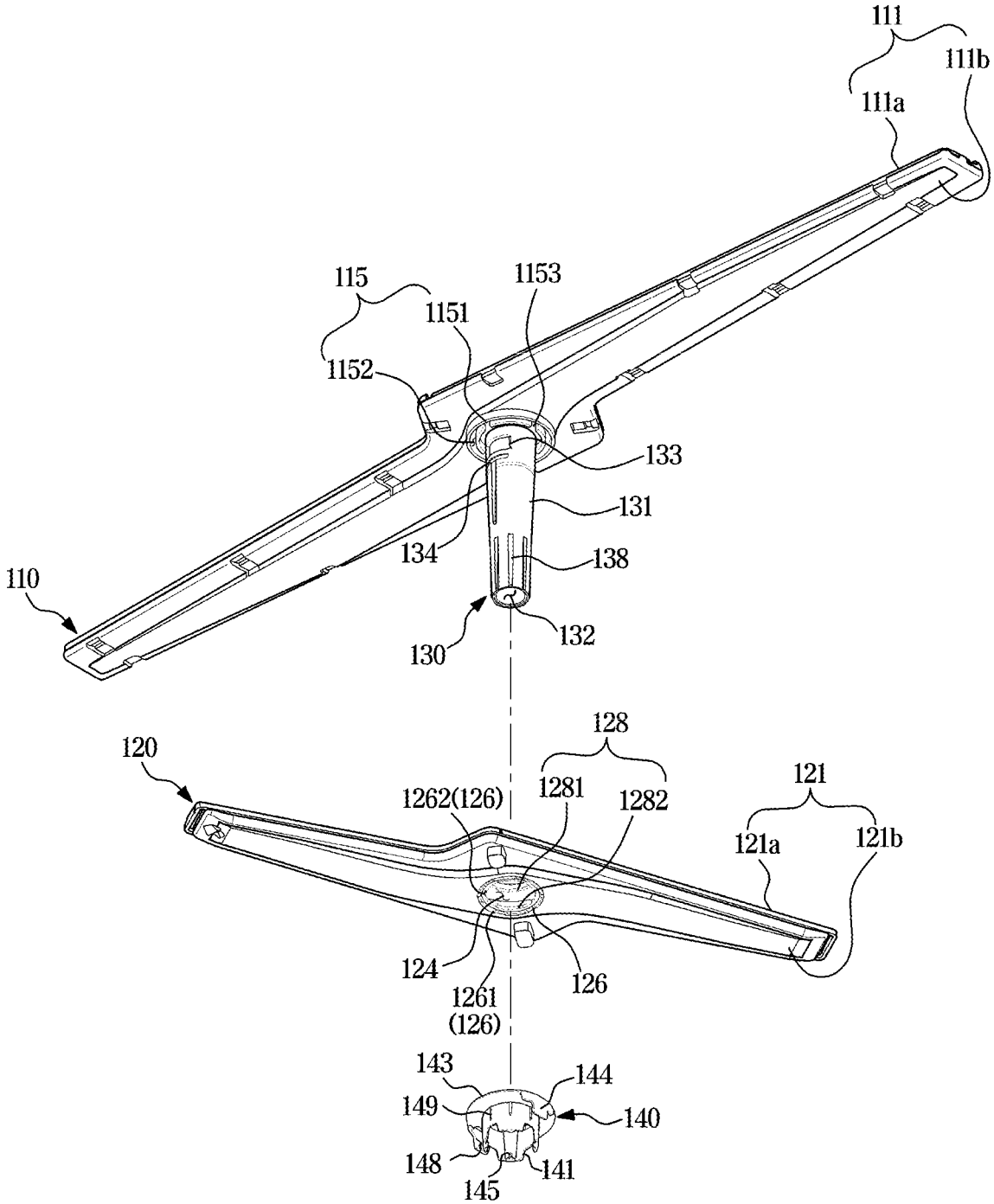
FIG. 5 is an exploded view illustrating the spray device of FIG. 4 when viewed from another direction.
Figure 6:
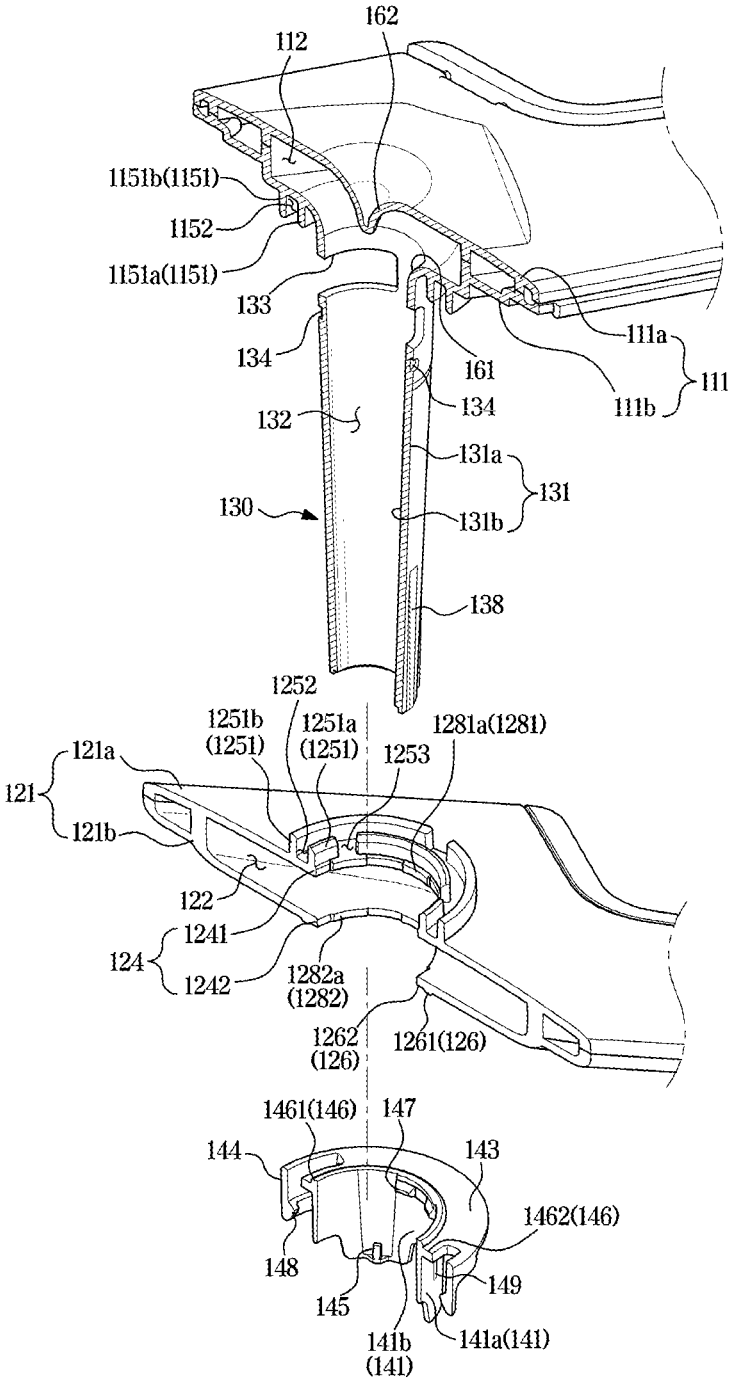
FIG. 6 is an exploded cross-sectional view illustrating an example of the spray device of the dishwasher according to an embodiment of the disclosure.

FIG. 3 is a perspective view illustrating an example of a spray device of the dishwasher according to an embodiment of the disclosure. FIG. 4 is an exploded view illustrating an example of the spray device of the dishwasher according to an embodiment of the disclosure. FIG. 5 is an exploded view illustrating the spray device of FIG. 4 when viewed from another direction. FIG. 6 is an exploded cross-sectional view illustrating an example of the spray device of the dishwasher according to an embodiment of the disclosure.

The spray device 100 according to an embodiment will be described with reference to the first spray device 41. The spray device 100 to be described below is not limited to the first spray device 41, and may be the second spray device 42 or the third spray device 43. That is, it will be understood that a structure of the first spray device 41 to be described below is applied to the second spray device 42 and the third spray device 43.

Referring to FIGS. 3 to 6, the spray device 100 may include a first spray rotor 110 and a second spray rotor 120.

The first spray rotor 110 may include a first spray arm 111 configured to spray washing water, and a shaft 130 integrally formed with the first spray arm 111. The shaft 130 may extend from the first spray arm 111.

The first spray arm 111 may be configured to spray washing water while rotating in a first direction R1. The first spray arm 111 may include a shape extending in one direction. For example, the first spray arm 111 may extend in one direction perpendicular to the extending direction of the shaft 130.

A first flow path 112 through which the washing water flows may be formed inside the first spray arm 111. A first nozzle 113 provided to spray washing water toward the washing chamber C may be formed in the first spray arm 111. The washing water flowing in the first flow path 112 may be sprayed through the first nozzle 113 communicating with the first flow path 112. The washing water sprayed through the first nozzle 113 may collide with the dishes to generate a strong washing power.

The first nozzle 113 may be provided in plurality, and the plurality of first nozzles 113 may be arranged to be spaced apart from each other in a longitudinal direction of the first spray arm 111.

The first spray arm 111 may be configured as an assembly. For example, the first spray arm 111 may include an upper body 111*a* and a lower body 111*b* coupled to a lower side of the upper body 111*a*. As the upper body 111*a* and the lower body 111*b* are coupled to each other, the first flow path 112 may be formed in the first spray arm 111. In this case, the lower body 111*b* may be integrally formed with the shaft 130. However, the disclosure is not limited thereto, and the first spray arm 111 may be provided as a single structure.

Further, the first spray arm 111 may be referred to as a first spray blade.

The shaft 130 may be integrally formed with the first spray arm 111. The shaft 130 may communicate with the first spray arm 111. The shaft 130 may extend in a vertical direction from the first spray arm 111.

The shaft 130 may guide the washing water supplied from the sump 70 to the first spray arm 111.

The shaft 130 may include a truncated cone shape in which a diameter is decreased as the distance from the first spray arm 111 is increased. Because the shaft 130 is formed in a truncated cone shape, an area, through which the washing water passes, gradually increases as the shaft 130 approaches the first spray arm 111. Accordingly, a speed of the washing water may decrease and a pressure of the washing water may increase. That is, in a process in which the washing water is guided by the shaft 130, the pressure of the washing water may be increased. As a result, as the pressure of the washing water sprayed through the spray device 100 increases, the washing power of the spray device 100 may be increased.

The shaft 130 may include a shaft body 131 forming an exterior and a guide flow path 132 formed inside the shaft body 131 to guide the washing water supplied from the sump 70. The shaft body 131 includes an outer peripheral surface 131*a* and an inner peripheral surface 131*b*. The washing water stored in the sump 70 may be introduced through an end of the shaft 130 and flow through the guide flow path 132, and then introduced into the first flow path 112 of the first spray arm 111 and a second flow path 122 of a second spray arm 121.

The shaft 130 may be coupled to the second spray rotor 120. The shaft 130 may be coupled to a holder 140 to be described later. For example, the shaft 130 may include a hook groove 134 corresponding to a first hook 147 of the holder 140. The hook groove 134 may be formed in an outer peripheral surface 131*a* of the shaft 130. The hook groove 134 may be provided in plurality, and the plurality of hook grooves 134 may be arranged to be spaced apart from each other along a peripheral direction of the outer peripheral surface 131*a* of the shaft 130.

The shaft 130 may include at least one communication hole 133 formed in the shaft body 131. The communication hole 133 may be provided to communicate with the second flow path 122 of the second spray rotor 120. That is, the guide flow path 132 of the shaft 130 and the second flow path 122 of the second spray rotor 120 may communicate through the communication hole 133. Accordingly, the communication hole 133 may guide a portion of the washing water, which is guided to the first spray arm 111 by the guide flow path 132, to flow into the second spray arm 121. That is, a portion of the washing water guided to the first spray arm 111 by the guide flow path 132 may be branched into the second spray arm 121. A detailed description of this will be provided later.

A first support protrusion 138 may be formed on the outer peripheral surface 131*a* of the shaft 130. The first support protrusion 138 may be arranged adjacent to an end side of the shaft 130. The first support protrusion 138 may be provided in plurality. The plurality of first support protrusions 138 may be provided to be spaced apart from each other along the peripheral direction of the outer peripheral surface 131*a* of the shaft 130. The first support protrusion 138 may be provided to be in contact with a supporting tube 150 to be described later.

The first spray rotor 110 may include a sealing member 115 provided to prevent leakage of washing water. A detailed description of this will be provided later.

The first spray rotor 110 may include curved members 161 and 162 provided to smooth the flow of washing water. A pressure loss of the washing water may occur in the process of moving to the spray device 100 through the sump 70, and the curved members 161 and 162 may be provided to reduce the pressure loss of the washing water.

For example, the curved members 161 and 162 may include a first curved member 161 provided to be curved between the shaft 130 and the first spray arm 111. The curved members 161 and 162 may include a second curved member 162 provided to allow an upper inner surface of the shaft 130 to be curved.

The second spray rotor 120 may be coupled to the first spray rotor 110. The second spray rotor 120 may be rotatably coupled to the shaft 130.

The second spray rotor 120 may include the second spray arm 121 configured to spray washing water. The second spray arm 121 may be provided to surround the shaft 130.

The second spray arm 121 may be provided to spray washing water while rotating in a second direction R2. For example, the second direction R2 may be opposite to the first direction R1. That is, the first spray arm 111 and the second spray arm 121 may spray washing water while rotating in opposite directions. Accordingly, the spray device 100 may spray the washing water in a wide range. However, the disclosure is not limited thereto, and the first spray arm 111 and the second spray arm 121 may rotate in the same direction. In addition, the first spray arm 111 and the second spray arm 121 may rotate at the same speed or at different speeds.

The second spray arm 121 may include a shape extending in one direction. For example, the second spray arm 121 may extend in one direction perpendicular to the extending direction of the shaft 130.

For example, the lower surface 12*b* of the tub 12 may be inclined downward, and additional components configured to wash dishes may be arranged on the lower surface 12*b* of the tub 120. Accordingly, a length L2 of the second spray arm 121 may be less than a length L1 of the first spray arm 111. That is, for a compact arrangement in the washing chamber C, the length of the first spray arm 111 and the length of the second spray arm 121 may be adjusted.

The second flow path 122 through which the washing water flows may be formed inside the second spray arm 121. A second nozzle 123 provided to spray washing water toward the washing chamber C may be formed in the second spray arm 121. The washing water flowing in the second flow path 122 may be sprayed through the second nozzle 123 communicating with the second flow path 122. The washing water sprayed through the second nozzle 123 may collide with the dishes to generate a strong washing power.

The second nozzle 123 may be provided in plurality, and the plurality of second nozzles 123 may be arranged to be spaced apart from each other in a longitudinal direction of the second spray arm 121.

Meanwhile, the number of the plurality of first nozzles 113 may be greater than the number of the plurality of second nozzles 123. Accordingly, a flow rate of the washing water W1 flowing to the first flow path 112 may be greater than a flow rate of the washing water W2 flowing into the second flow path 122. However, the disclosure is not limited thereto, and the number of the plurality of first nozzles 113 may be less than or equal to the number of the plurality of second nozzles 123.

The second spray arm 121 may be configured as an assembly. For example, the second spray arm 121 may include an upper body 121*a* and a lower body 121*b* coupled to a lower side of the upper body 121*a*. As the upper body 121*a* and the lower body 121*b* are coupled to each other, the second flow path 122 may be formed in the second spray arm 121. However, the disclosure is not limited thereto, and the second spray arm 121 may be provided as a single structure.

Further, the second spray arm 121 may be referred to as a second spray blade.

The second spray rotor 120 may include a shaft hole 124 formed in the second spray arm 121 to allow the shaft 130 to pass therethrough. The shaft hole 124 may be formed in a central portion of the second spray arm 121. For example, the shaft hole 124 may include a first shaft hole 1241 formed in the upper body 121*a* and a second shaft hole 1242 formed in the lower body 121*b*.

The second spray rotor 120 may include a rotation guide 128 formed in the shaft hole 124 to reduce friction with the shaft 130 during rotation. The rotation guide 128 may reduce a frictional resistance with the shaft 130 to promote a smooth rotation of the second spray rotor 120.

The rotation guide 128 may include a plurality of guide protrusions 1281*a* and 1282*a* protruding toward the shaft 130 so as to be in contact with the outer peripheral surface of the shaft 130 and spaced apart along the peripheral direction of the shaft hole 124. In addition, as the plurality of guide protrusions 1281*a* and 1282*a* protrude inward by a predetermined length in the radial direction, a gap may be generated between a region, in which the plurality of guide protrusions 1281*a* and 1282*a* is not formed in the rotation guide 128, and the shaft 130. Through the predetermined gap, very small food residues and the like (for example, coffee powder) may be easily discharged. In addition, the plurality of guide protrusions 1281*a* and 1282*a* may support the outer peripheral surface of the shaft 130. The plurality of guide protrusions 1281*a* and 1282*a* may be arranged along the peripheral direction of the shaft hole 124 at regular intervals, and may support the outer peripheral surface of the shaft 130 with a uniform force. Therefore, the vibration of the shaft 130 may be reduced, and excessive water leakage between the shaft 130 and the second spray rotor 120 may be prevented.

For example, the rotation guide 128 may include a first rotation guide 1281 formed in the first shaft hole 1241 of the upper body 121*a* and a second rotation guide 1282 formed in the second shaft hole of the lower body 121*b*. The first rotation guide 1281 may include the plurality of first guide protrusions 1281*a* protruding toward the shaft 130 and spaced apart from each other in the peripheral direction of the first shaft hole 1241. The second rotation guide 1282 may include the plurality of second guide protrusions 1282*a* protruding toward the shaft 130 and spaced apart from each other in the peripheral direction of the second shaft hole 1242.

For example, the first rotation guide 1281 and the second rotation guide 1282 may be provided as a pair.

The second rotation guide 1282 may be vertically spaced apart from the first rotation guide 1281. That is, an upper portion and a lower portion of the shaft 130, to which the second spray rotor 120 is coupled, are supported by the first rotation guide 1281 and the second rotation guide 1282, and thus during the rotation of the shaft 130, the vibration of the shaft 130 may be reduced.

The second spray rotor 120 may include sealing member 125 and 126 provided to prevent leakage of washing water. A detailed description of this will be provided later.

The dishwasher 1 may further include the holder 140 provided to support the second spray rotor 120. The holder 140 may be arranged below the second spray rotor 120. The holder 140 may be coupled to the outer peripheral surface of the shaft 130.

The holder 140 may include a holder body 141 forming a hollow 142. The shaft 130 may be inserted into the hollow 142 of the holder 140. The shaft 130 may be fitted into the hollow 142 of the holder 140. The holder body 141 may surround the outer peripheral surface of the shaft 130. The holder 140 may include a substantially ring shape.

The holder body 141 may include the first hook 147 protruding toward the shaft 130 from an inner peripheral surface 141*b* of the holder body 141. The first hook 147 may be formed on one side of the inner peripheral surface 141*b* adjacent to the second spray rotor 120. For example, the first hook 147 may be provided in plurality, and the plurality of first hooks 127 may be arranged to be spaced apart from each other along a peripheral direction of the inner peripheral surface 141*b* of the holder body 141.

The first hook 147 may correspond to the hook groove 134 formed on the outer peripheral surface 131*a* of the shaft 130. The first hook 147 may be provided to engage the hook groove 134. Accordingly, the hook 140 and the shaft 130 may be stably coupled to each other, and the vibration of the first spray rotor 110 may be reduced. In addition, an assembling property of the spray device 100 may be improved.

A shaft support 145 provided to support the outer peripheral surface 131*a* of the shaft 130 may be provided on the inner peripheral surface 141*b* of the holder body 141. The shaft support 145 may protrude toward the shaft 130. The shaft support 145 may be formed on one side of the inner peripheral surface 141*b* far from the second spray rotor 120. For example, the shaft support 145 may elastically support the outer peripheral surface 131*a* of the shaft 130.

The holder 140 may include a rotor support 143 provided to support the lower portion of the second spray rotor 120. A part of a lower portion of the second spray arm 121 of the second spray rotor 120 may be mounted on the rotor support 143. The rotor support 143 may extend radially from an upper end of the holder body 141. For example, a maximum diameter of the rotor support 143 may be greater than a maximum diameter of the holder body 141 and thus the rotor support 143 may stably support the second spray rotor 120.

The holder 140 may include an extension 144 extending from the rotor support 143. The extension 144 may extend downward.

The holder 140 may include a flange hook (second hook) 148 formed on an inner surface of the extension 144 to engage a flange 153 of the supporting tube 150 to be described later. The flange hook 148 may protrude radially inward toward the flange 153. For example, the flange hook 148 may be provided in plurality, and the plurality of flange hooks 148 may be arranged to be spaced apart from each other along a peripheral direction of the extension 144.

The holder 140 may include a second support protrusion 149 formed on an outer peripheral surface 141*a* of the holder body 141. The second support protrusion 149 may be arranged on the side of the outer peripheral surface 141*a* adjacent to the second spray rotor 120. The second support protrusion 149 may be provided in plurality. The plurality of second support protrusions 149 may be provided to be spaced apart from each other along a peripheral direction of the outer peripheral surface 141*a* of the holder body 141. The second support protrusion 149 may be provided to be in contact with the supporting tube 150 to be described later.

The holder 140 may include a sealing member 146 provided to prevent leakage of washing water. A detailed description of this will be provided later.

The spray device 100 may be formed of a material resistant to chemical deformation, thermal deformation, and the like. For example, the spray device 100 may be formed of a material such as polypropylene (PP), or polyoxymethylene (POM). However, the disclosure is not limited thereto, and the spray device 100 may be formed of various materials having excellent corrosion resistance and heat resistance.

The first spray rotor 110 and the second spray rotor 120 may be formed of a material different from that of the holder 140. Accordingly, a frictional resistance between the first spray rotor 110 and the holder 140 may be reduced, and a frictional resistance between the second spray rotor 120 and the holder 140 may be reduced. That is, the first spray rotor 110 and the second spray rotor 120 may rotate more smoothly. For example, the first spray rotor 110 and the second spray rotor 120 may be formed of a polypropylene (PP) material, and the holder 140 may be formed of a polyoxymethylene (POM) material. However, the disclosure is not limited thereto, and it is sufficient that the first and second spray rotors 110 and 120 and the holder 140 are formed of different materials to reduce friction. Alternatively, the first and second spray rotors 110 and 120 and the holder 140 may be formed of the same material.

In addition, each of the first spray rotor 110, the second spray rotor 120, and the holder 140 may include only one material as an integral body, or may include a plurality of materials as necessary. For example, the first spray rotor 110, the second spray rotor 120, and the holder 140 may be provided such that only a material of a member coupled to the other component is different. For example, only the material of the sealing member and the rotation guide may be provided to be different.

Figure 7:
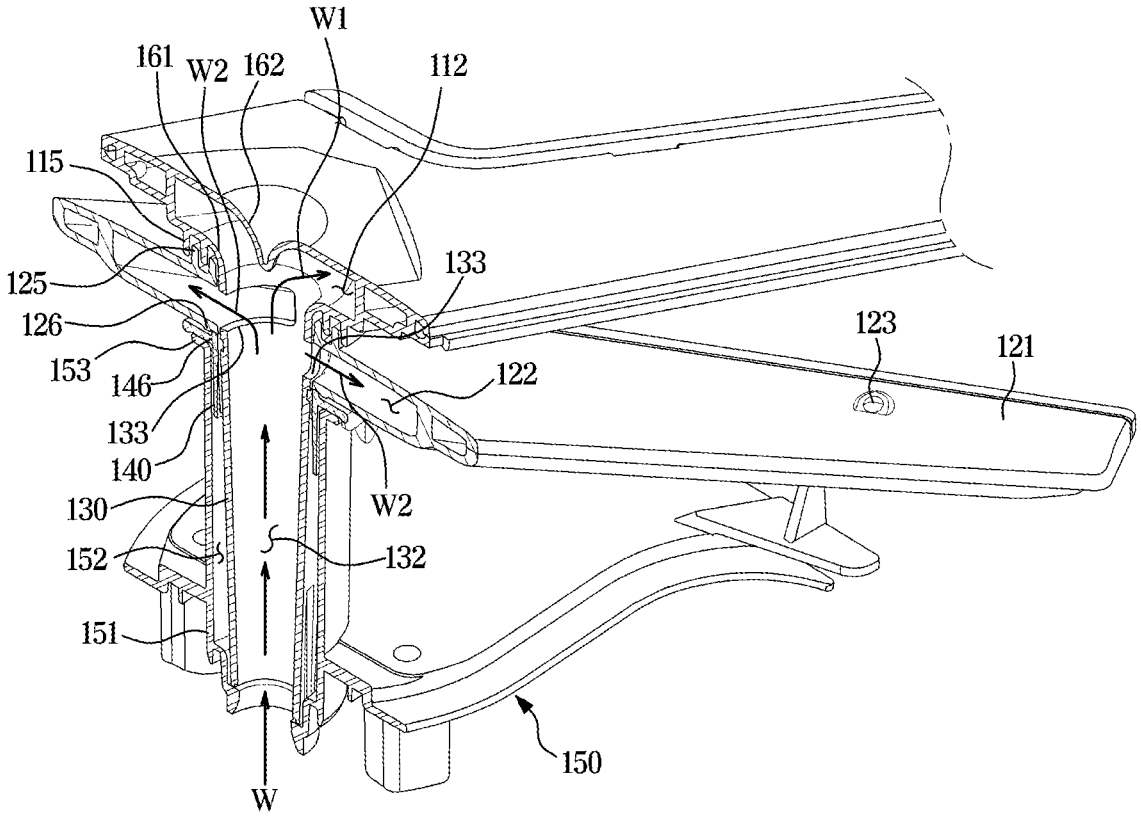
FIG. 7 is a view illustrating a part, which is cut, of an example of the spray device of the dishwasher according to an embodiment of the disclosure.
Figure 8:
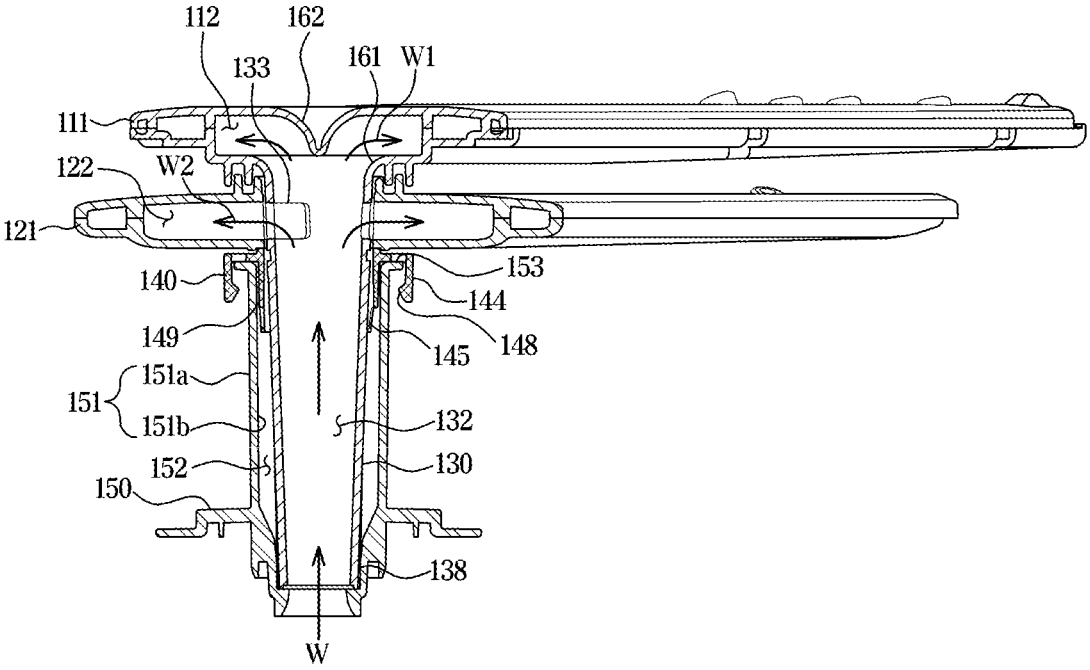
FIG. 8 is a view illustrating the spray device of FIG. 7 when viewed from a cut surface.
Figure 9:
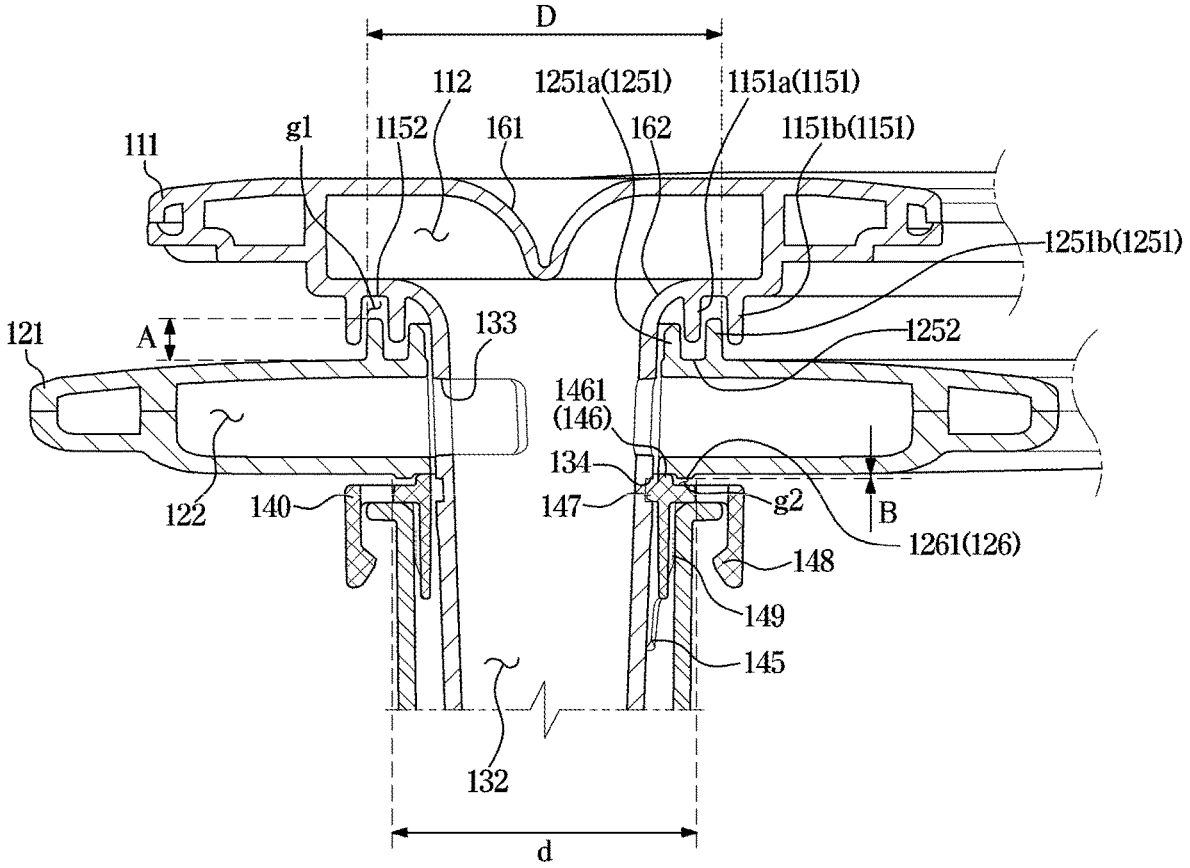
FIG. 9 is an enlarged-view illustrating a part of an upper portion of the spray device of FIG. 8.
Figure 10:
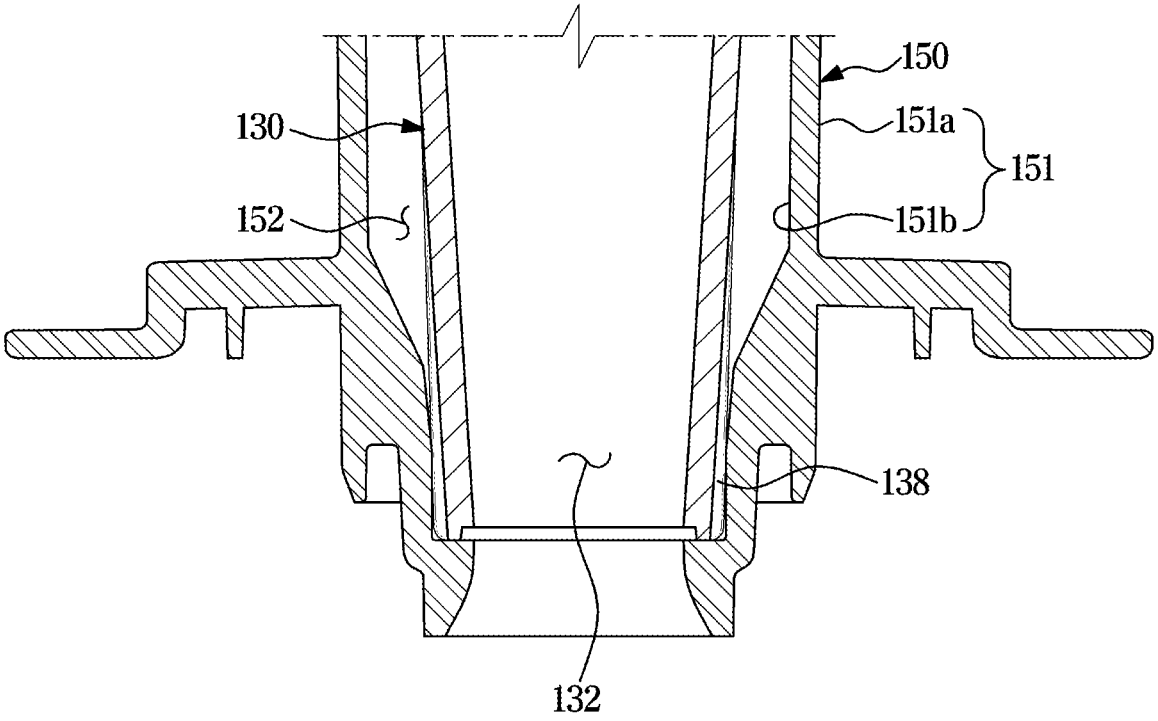
FIG. 10 is an enlarged-view illustrating a part of a lower portion of the spray device of FIG. 8.

FIG. 7 is a view illustrating a part, which is cut, of an example of the spray device of the dishwasher according to an embodiment of the disclosure. FIG. 8 is a view illustrating the spray device of FIG. 7 when viewed from a cut surface. FIG. 9 is an enlarged-view illustrating a part of an upper portion of the spray device of FIG. 8. FIG. 10 is an enlarged-view illustrating a part of a lower portion of the spray device of FIG. 8.

Referring to FIGS. 7 to 10, the dishwasher 1 may further include the supporting tube 150 provided to support the outer peripheral surface 131*a* of the shaft 130.

The supporting tube 150 may be provided such that one end thereof is connected to the holder 140 and the other end thereof is connected to the sump 70. The other end of the supporting tube 150 may receive washing water through the connector 81 connected to the sump 70. The washing water may be introduced into the other end of the supporting tube 150.

The supporting tube 150 may include a tube body 151 forming a hollow 152. The tube body 151 may form an exterior of the supporting tube 150.

The supporting tube 150 may include the flange 153 bent radially outward from one end. The flange 153 may be provided to engage the flange hook (second hook) 148 of the holder 140. The separation of the flange 153 may be prevented by the flange hook 148 of the holder 140.

Referring to FIG. 8, the shaft 130 may include the first support protrusion 138 protruding to be in contact with an inner peripheral surface 151*b* of the supporting tube 150. The holder 140 may include the second support protrusion 149 protruding to be in contact with the inner peripheral surface of the supporting tube 150. The first support protrusion 138 may be formed on the outer peripheral surface 131*a* of the shaft 130 to correspond to the inner surface 151*b* of a portion of the supporting tube 150, and the second support protrusion 149 may be formed on the outer peripheral surface 141*a* to correspond to the inner surface 151*b* of another portion of the supporting tube 150.

For example, the first support protrusion 138 and the second support protrusion 149 may be vertically spaced apart from each other. Accordingly, a portion corresponding to a relatively upper side of the supporting tube 150 may be in close contact with the first support protrusion 138, and a portion corresponding to a relatively lower side of the supporting tube 150 may be in close contact with the second support protrusion 149. Accordingly, the shaft 130 inserted into the hollow 152 of the supporting tube 150 may be supported. A portion corresponding to a relatively lower side of the shaft 130 may be supported by the supporting tube 150 and the first support protrusion 138. A portion corresponding to a relatively upper side of the shaft 130 may be supported by the supporting tube 150 and the second support protrusion 149. That is, because the upper and lower portions of the shaft 130 are supported by the supporting tube 150 and the support protrusions 138 and 149, the vibration of the shaft 130 may be effectively reduced.

Referring to FIGS. 6 to 9, the first spray rotor 110 may include the first sealing member 115. The first sealing member 115 may be arranged adjacent to the shaft 130. The first sealing member 115 may be arranged adjacent to the second spray rotor 120.

The first sealing member 115 may include at least one first sealing protrusion 1151 protruding toward the second spray arm 121 of the second spray rotor 120. The first sealing protrusion 1151 may extend integrally from the lower body 111*b* of the first spray arm 111. The first sealing member 115 may include at least one first sealing groove 1152 arranged adjacent to the first sealing protrusion 1151. The first sealing protrusion 1151 and the first sealing groove 1152 may be alternately formed in the radial direction.

For example, the first sealing protrusion 1151 may include a ring shape. The first sealing protrusion 1151 may extend along the peripheral direction of the shaft 130. The first sealing protrusion 1151 may include a shape surrounding the shaft 130. A portion of the first sealing protrusion 1151 may be cut out. For example, the first sealing member 115 may include a cutout 1153 in which the first sealing protrusion 1151 is partially cut out. That is, when it is assumed that the first sealing protrusion 1151 includes a ring shape, the ring shape may include an intermittent ring shape as well as a continuous ring shape. The cutout 1153 may be provided to prevent refuse such as food waste from being caught.

Based on the first sealing protrusion 1151 being provided in plurality, the protrusions 1151*a* and 1151*b* having different diameters may be formed to share the same center. That is, the protrusions 1151*a* and 1151*b* may be provided as concentric circles. At least one first sealing groove 1152 may be provided between the protrusions 1151*a* and 1151*b* or between the protrusion 1151*a* and the shaft 130.

The second spray rotor 120 may include the second sealing member 125 corresponding to the first sealing member 115. The second sealing member 125 may be arranged adjacent to the first spray arm 111 of the first spray rotor 110. The second sealing member 125 may be arranged adjacent to the shaft hole 124. The second sealing member 125 may be arranged adjacent to the first shaft hole 1241 provided in the upper body 121*a* of the second spray arm 121.

The second sealing member 125 may include at least one second sealing protrusion 1251 protruding toward the first spray arm 111 of the first spray rotor 110. The second sealing protrusion 1251 may extend integrally from the upper body 121*a* of the second spray arm 121. The second sealing member 125 may include at least one second sealing groove 1252 arranged adjacent to the second sealing protrusion 1251. The second sealing protrusion 1251 and the second sealing groove 1252 may be alternately formed in the radial direction.

For example, the second sealing protrusion 1251 may include a ring shape. The second sealing protrusion 1251 may extend along the peripheral direction of the shaft hole 124. A portion of the second sealing protrusion 1251 may be cut out. For example, the second sealing member 125 may include a cutout 1253 in which a portion of the second sealing protrusion 1251 is cut out. That is, when it is assumed that the second sealing protrusion 1251 includes a ring shape, the ring shape may include an intermittent ring shape as well as a continuous ring shape. The cutout 1253 may be configured to prevent refuse such as food waste from being caught.

Further, the cutouts 1153 and 1253 may be provided in at least one of the first sealing member 115 and the second sealing member 125. That is, the cutout may be provided only in the first sealing member 115, only in the second sealing member 125, or may be provided in both the first sealing member 115 and the second sealing member 125.

Based on the second sealing protrusion 1251 being provided in plurality, the protrusions 1251*a* and 1251*b* having different diameters may be formed to share the same center. That is, the protrusions 1251*a* and 1251*b* may be provided as concentric circles. At least one second sealing groove 1252 may be provided between the protrusions 1251*a* and 1251*b*.

The first sealing member 115 of the first spray rotor 110 and the second sealing member 125 of the second spray rotor 120 may be coupled to each other to reduce leakage of washing water.

For example, the first sealing member 115 and the second sealing member 125 may be provided in a labyrinth seal structure. At least one first sealing protrusion 1151 of the first sealing member 115 may be inserted into the at least one second sealing groove 1252 of the second sealing member 125. At least one second sealing protrusion 1251 of the second sealing member 125 may be inserted into the at least one first sealing groove 1152 of the first sealing member 115. The at least one second sealing protrusion 1251 may be provided to be alternately arranged with the first sealing protrusion 1151 in the radial direction.

In a conventional dishwasher in which the spray device is provided with a plurality of rotors, a ball bearing or a roller bearing may be provided between the plurality of rotors. The ball bearing or roller bearing may be used for coupling between the plurality of rotors or to reduce friction. However, refuse such as food waste may be caught between the rolling element (ball or roller) and a case thereof. That is, the ball bearing or roller bearing may be susceptible to contamination.

In contrast, a predetermined gap g1 may be provided between the first sealing member 115 and the second sealing member 125. Even if refuse is caught between the sealing members, washing water may flow in the gap g1 and thus the refuse may be easily washed. That is, the structure of the sealing members 115 and 125 of the disclosed spray device 100 may be resistant to contamination. Accordingly, the cleaning of the spray device 100 becomes easier, and thus the ease of use may be improved.

In addition, the cutouts 1153 and 1253 may be provided in at least one of the first sealing member 115 and the second sealing member 125, and thus even when refuse such as food waste is introduced into between the first sealing member 115 and the second sealing member 115, the refuse may easily escape through the cutout. That is, the refuse caught between the first sealing member 115 and the second sealing member 125 may be easily discharged to the outside of the spray device 100 through the cutouts 1153 and 1253. Accordingly, the cleaning of the spray device 100 is easy.

For example, the first sealing member 115 and the second sealing member 125 may be provided in a pair.

The second spray rotor 120 may include the third sealing member 126. The third sealing member 126 may be arranged adjacent to the holder 140. The third sealing member 126 may be arranged adjacent to the shaft hole 124. The third sealing member 126 may be arranged adjacent to the second shaft hole 1242 provided in the lower body 121*b* of the second spray arm 121.

The third sealing member 126 may include at least one third sealing protrusion 1261 protruding toward the holder 140. The third sealing protrusion 1261 may extend integrally from the lower body 121*b* of the second spray arm 121. The third sealing member 126 may include at least one third sealing groove 1261 arranged adjacent to the third sealing protrusion 1261. The third sealing protrusion 1261 and the third sealing groove 1261 may be alternately formed in the radial direction.

For example, the third sealing protrusion 1261 may include a ring shape. The third sealing protrusion 1261 may extend along the peripheral direction of the shaft hole 124. A portion of the third sealing protrusion may be cut out. For example, the third sealing member 126 may include a cutout (not shown) in which a part of the third sealing protrusion is cut out to allow foreign substances such as food waste to easily escape.

On the drawings, the third sealing protrusion 1261 is illustrated as a protrusion including a single ring shape, but the disclosure is not limited thereto. Accordingly, the third sealing protrusion 1261 may be provided in plurality. For example, the plurality of third sealing protrusions may be provided in concentric circles, and at least one third sealing groove may be provided between the plurality of third sealing protrusions.

The holder 140 may include the fourth sealing member 146 corresponding to the third sealing member 126. The fourth sealing member 146 may be arranged adjacent to the second spray rotor 120. The fourth sealing member 146 may be provided at the upper end of the holder body 141. The fourth sealing member 146 may be arranged adjacent to the hollow 142.

The fourth sealing member 146 may include at least one fourth sealing protrusion 1461 protruding toward the second spray rotor 120. The fourth sealing protrusion 1461 may extend integrally from the holder body 141. The fourth sealing member 146 may include at least one fourth sealing groove 1462 arranged adjacent to the fourth sealing protrusion 1461. The fourth sealing protrusion 1461 and the fourth sealing groove 1462 may be alternately formed in the radial direction. For example, the fourth sealing groove 1462 may be provided on the same plane as the rotor support 143. The fourth sealing protrusion 1461 may be provided to protrude more than the rotor support 143.

For example, the fourth sealing protrusion 1461 may include a ring shape. The fourth sealing protrusion 1461 may extend along the peripheral direction of the hollow 142. The fourth sealing protrusion 1461 may include a shape surrounding the hollow 142. A portion of the fourth sealing protrusion 1461 may be cut out. For example, the fourth sealing member 146 may include a cutout (not shown) in which a part of the fourth sealing protrusion 1461 is cut out to allow foreign substances such as food waste to easily escape.

Meanwhile, a cutout (not shown) may be provided in at least one of the third sealing member 126 and the fourth sealing member 146. Even when refuse, such as food waste, is introduced into between the third sealing member 126 and the fourth sealing member 146, the refuse may easily escape through the cutout, and thus the cleaning of the spray device 100 is easy.

For example, the third sealing member 126 and the fourth sealing member 146 may be provided in a pair.

On the drawings, the fourth sealing protrusion 1461 is illustrated as a protrusion including a single ring shape, but the disclosure is not limited thereto. Accordingly, the fourth sealing protrusion 1461 may be provided in plurality. For example, the plurality of fourth sealing protrusions may be provided in concentric circles, and at least one fourth sealing groove may be provided between the plurality of fourth sealing protrusions The third sealing member 126 of the second spray rotor 120 and the fourth sealing member 146 of the holder 140 may be coupled to each other to reduce leakage of washing water.

For example, the third sealing member 126 and the fourth sealing member 146 may be provided in a labyrinth seal structure. The at least one third sealing protrusion 1261 may be inserted into the at least one fourth sealing groove 1462. At least one fourth sealing protrusion 1461 of the fourth sealing member 146 may be inserted into the at least one third sealing groove 1262. The at least one third sealing protrusion 1261 may be provided to be alternately arranged with the at least one fourth sealing protrusion 1461 in the radial direction.

A predetermined gap g2 may be provided between the third sealing member 126 and the fourth sealing member 146. Even if refuse is caught between the sealing members, washing water may flow in the gap g2, and thus the refuse may be easily washed. That is, the structure of the sealing members 126 and 146 of the disclosed spray device 100 may be resistant to contamination in comparison with a structure to which a ball bearing or a roller bearing is applied.

Referring to FIG. 9, an outermost diameter D of the second sealing protrusion 1251 may be greater than an outermost diameter d of the third sealing protrusion 1261. The third sealing member 126 may be provided to receive a greater load than the second sealing member 125, and thus the third sealing member 126 and the fourth sealing member 146 may be in close contact with each other. Accordingly, even when the third sealing protrusion 1261 of the third sealing member 126 protrudes less than the second sealing protrusion 1251 of the second sealing member 125, the third sealing member 126 and the fourth sealing member 146 corresponding to the third sealing member 126 may effectively prevent leakage of washing water. That is, even when the third sealing member 126 and the fourth sealing member 146 are provided in the shape of a small labyrinth seal, it is possible to sufficiently perform the function of reducing the leakage of washing water. For example, a protruding length A of the second sealing protrusion 1251 may be greater than a protruding length B of the third sealing protrusion 1261.

Further, in the conventional dishwasher, because a separate ball bearing or roller bearing is provided and assembled between the spray rotors, the structure of the spray device may become complicated, and manufacturing cost and manufacturing time may increase. In contrast, the spray device 100 may be configured only by a combination of the first spray rotor 110 and the second spray rotor 120 without a separate ball bearing or roller bearing. That is, because the spray device 100 is provided with a simple structure, the cost and time required for manufacturing the spray device 100 may be greatly reduced. For example, the first sealing member 115 of the first spray rotor 110 may be coupled to the second sealing member 125 of the second spray rotor 120. The rotation guide 128 provided in the shaft hole 124 of the second spray rotor 120 may be coupled to the outer peripheral surface of the shaft 130 of the first spray rotor 110. In addition, the holder 140 may be coupled to the outer peripheral surface of the shaft 130, thereby stably supporting the second spray rotor 120.

Washing water introduced into the spray device 100 may flow into the second spray arm 121 while flowing to the first spray arm 111 along the guide flow path 132 of the shaft 130. That is, the washing water may be branched into the first flow path 112 and the second flow path 122 while being guided in one guide flow path 132. Hereinafter an example of a flow process of washing water will be described with reference to FIGS. 7 and 8.

Washing water stored in the sump 70 may be pumped by the washing pump 30 and introduced into the end of the shaft 130 through the connector 81.

The washing water W introduced into the shaft 130 may flow along the guide flow path 132. For example, a moving direction of the washing water introduced into the shaft 130 may correspond to the extending direction of the guide flow path 132 of the shaft 130. For example, the washing water introduced into the shaft 130 may flow upward.

The washing water introduced into the shaft 130 may be guided to the first spray arm 111 by the shaft 130. In this case, the shaft 130 may include a truncated cone shape in which an area increases along the guide direction. Due to the shape of the shaft 130, the speed and pressure of the washing water may increase in the process of being guided.

A portion W2 of the washing water guided by the shaft 130 may be introduced into the second flow path 122 through the communication hole 133 that connects the guide flow path 132 and the second flow path 122 of the second spray rotor 120. That is, the portion W2 of the washing water guided by the shaft 130 may be branched to the second spray arm 121. The washing water introduced into the second flow path 122 may be sprayed into the washing chamber C through the second nozzle 123.

Washing water W1, which is not introduced into the second flow path 122 through the communication hole 133, may collide with the upper inner surface of the first spray arm 111 during the flow process, and be introduced into the first flow path 112 of the first spray arm 111 extending from the guide flow path 132. The washing water introduced into the first flow path 112 may be sprayed into the washing chamber C through the first nozzle 113.

For example, because the first spray rotor 110 is relatively closer to the dishes than the second spray rotor 120, it may be appropriate that an injection pressure of the washing water of the first spray rotor 110 is greater than or equal to an injection pressure of the washing water of the second spray rotor 120 based on the cleaning power efficiency. According to the disclosed example, most of the washing water W flowing into the spray device 100 may flow along the extension direction of the guide flow path 132 and flow into the first flow path 112 integrally connected to the guide flow path 132. Therefore, a flow rate of the washing water W1 flowing into the first flow path 112 may be greater than a flow rate of the washing water W2 flowing into the second flow path 122. In addition, because the pressure of the washing water increases while being guided by the guide flow path 132, a hydraulic pressure of the washing water W1 flowing into the first flow path 112 may be relatively high compared to a hydraulic pressure of the washing water W2. Accordingly, the washing water having a strong injection pressure may be sprayed from the first spray rotor 110. However, this is merely exemplary and is not limited thereto. According to the structure of the washing chamber C, washing water having a stronger injection pressure than that of the first spray rotor 110 may be sprayed from the second spray rotor 120.

Meanwhile, as the washing water W1 collides with the upper inner surface of the first spray arm 111 while flowing into the first flow path 112, a pressure loss may occur. A direction of the washing water W1 may change while flowing into the first flow path 112, and thus a pressure loss may occur. For example, while the washing water W1 flows upward along the guide flow path 132 and flows into the first flow path 112 and moves in the left and right directions, a pressure loss may occur.

To prevent the pressure loss, the first spray rotor 110 may include curved members 161 and 162 provided to smooth the flow of washing water. The curved members 161 and 162 may be provided to reduce the pressure loss of the washing water.

For example, the curved members 161 and 162 may include the first curved member 161 provided to be curved between the shaft 130 and the first spray arm 111. The curved members 161 and 162 may include the second curved member 162 provided to allow an upper inner surface of the shaft 130 to be curved. Accordingly, the curved members 161 and 162 may reduce the pressure loss of the washing water by preventing a rapid change in the flow direction of the washing water. That is, the flow loss of washing water may be minimized.

Although not shown in the drawing, a curved member provided to reduce the pressure loss of the washing water W2 flowing into the second flow path 122 may be provided. For example, the edge of the communication hole 133 may include a curved shape. Accordingly, the pressure loss of the washing water may be reduced.

Flow losses of washing water may be minimized.

As is apparent from the above description, a dishwasher may effectively fix a plurality of rotors with a simpler structure.

Further, a dishwasher may reduce a pressure loss of washing water supplied to a spray device.

Further, a dishwasher may prevent foreign substances from being caught in a spray device.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:

a tub;

a basket inside the tub to accommodate an object to wash;

a spray device configured to spray washing water to wash the Object accommodated in the basket; and a sump configured to supply the washing water stored therein to the spray device;

wherein the spray device comprises:

a first spray rotor comprising:

a first spray arm configured to spray the washing water; and a shaft integrally formed with the first spray arm to guide the washing water supplied from the sump to the first spray arm therethrough;

a second spray rotor rotatably coupled to the shaft, the second spray rotor comprising:

a second spray arm configured to spray the washing water branched from the washing water which is guided to the first spray arm through the shaft; and a shaft hole formed in the second spray arm to allow the shaft to pass therethrough; and a communication hole formed in the shaft to allow the shaft to communicate with the second spray arm so that a portion of the washing water, which is guided to the first spray arm to flow into the second spray arm.

2. The dishwasher of claim 1, further comprising:

a holder coupled to an outer peripheral surface of the shaft to support the second spray rotor.

3. The dishwasher of claim 2, further comprising:

a supporting tube to support the outer peripheral surface of the shaft and formed such that one end of the supporting tube is connected to the holder and an other end of the supporting tube is connected to the sump.

4. The dishwasher of claim 3, wherein:

the shaft and the holder are inserted into the supporting tube;

the shaft comprises a first support protrusion protruding to be in contact with an inner peripheral surface of the supporting tube; and the holder comprises a second support protrusion protruding to be in contact with the inner peripheral surface of the supporting tube and vertically spaced apart from the first support protrusion.

5. The dishwasher of claim 3, wherein:

the first spray rotor further comprises at least one first sealing protrusion protruding toward the second spray arm of the second spray rotor and at least one first sealing groove adjacent to the at least one first sealing protrusion;

the second spray rotor further comprises at least one second sealing protrusion protruding toward the first spray arm of the first spray rotor and at least one second sealing groove adjacent to the at least one second sealing protrusion; and when the first spray rotor is coupled to the second spray rotor, the at least one first sealing protrusion is inserted into the at least one second sealing groove corresponding to the at least one first sealing protrusion.

6. The dishwasher of claim 5, wherein:

the second spray rotor further comprises at least one third sealing protrusion protruding toward the holder; and, the holder further comprises at least one fourth sealing protrusion protruding toward the second spray rotor and alternately arranged with the at least one third sealing protrusion with respect to the radial direction.

7. The dishwasher of claim 6, wherein:

the second sealing protrusion of the second spray rotor has a ring shaped and the third sealing protrusion of the second spray rotor has a ring shaped;

an outermost diameter of the second sealing protrusion is greater than an outermost diameter of the third sealing protrusion; and a protruding length of the second sealing protrusion is greater than a protruding length of the third sealing protrusion.

8. The dishwasher of claim 5, wherein the at least one first sealing protrusion and the at least one first sealing groove is alternatively formed in a radial direction, and the at least one second sealing protrusion and the at least one second sealing groove is alternatively formed in the radial direction.

9. The dishwasher of claim 3, wherein:

the supporting tube further comprises a flange bent outward in a radial direction from the one end of the supporting tube;

the holder further comprises a flange hook protruding radially inward toward the flange to be engaged with the flange of the supporting tube.

10. The dishwasher of claim 2, wherein:

the holder further comprises a hook protruding toward the shaft; and the shaft further comprises a hook groove to be engaged with the hook.

11. The dishwasher of claim 2, wherein the first spray rotor and the second spray rotor are formed of a material different from a material of the holder to reduce friction with the holder.

12. The dishwasher of claim 1, wherein the second spray rotor further comprises a rotation guide formed in the shaft hole to reduce friction with the shaft, the rotation guide comprising a plurality of guide protrusions protruding toward a center of the shaft hole and to be in contact with an outer peripheral surface of the shaft when the shaft is inserted into the shaft hole, the plurality of guide protrusions being spaced apart from each other along a peripheral direction of the shaft hole.

13. The dishwasher of claim 12, wherein:

the second spray arm further comprises an upper body and a lower body coupled to a lower side of the upper body to form a flow path through which the washing water flows, the shaft hole further comprises a first shaft hole formed in the upper body and a second shaft hole formed in the lower body, and the rotation guide further comprises:

a first rotation guide formed in the first shaft hole; and a second rotation guide formed in the second shaft hole and vertically spaced apart from the first rotation guide.

14. The dishwasher of claim 1, wherein the first spray rotor further comprises a curved member formed to be curved between the shaft and the first spray arm to reduce a pressure loss of the washing water guided to the first spray arm through the shaft.

15. The dishwasher of claim 1, wherein the shaft comprises a truncated cone shape in which a diameter of the shaft is reduced as a distance from the first spray arm is increased.

16. The dishwasher of claim 1, wherein:

each of the first spray arm and the second spray arm extends in a direction perpendicular to an extension direction of the shaft;

an extension length of the first spray arm is greater than an extension length of the second spray arm;

the first spray arm comprises a plurality of first nozzles along a longitudinal direction of the first spray arm, and the second spray arm comprises a plurality of second nozzles along a longitudinal direction of the second spray arm; and a number of the plurality of first nozzles is greater than a number of the plurality of second nozzles.

17. A dishwasher comprises:

a tub forming a washing chamber;

a first spray arm to be rotated in a first direction to spray washing water to the washing chamber;

a shaft integrally formed with the first spray arm to extend downwardly from the first spray arm and to guide the washing water to the first spray arm;

a second spray arm on a lower side of the first spray arm and to be rotated in a second direction to spray the washing water to the washing chamber;

a shaft hole formed in the second spray arm and to allow the shaft to penetrate through the second spray arm so that the second spray arm to be rotatably coupled to an outer peripheral surface of the shaft;

a pair of sealing members between the first spray arm and the second spray arm to prevent a leakage of the washing water, the pair of sealing members including:

a first sealing member formed on a lower side of the first spray arm; and a second sealing member formed in an upper side of the second spray arm to correspond to the first sealing member; and a pair of rotation guides in the shaft hole to guide a rotation of the second spray arm and the shaft, the pair of rotation guides including a first rotation guide and a second rotation guide vertically spaced part from the first rotation guide.

18. The dishwasher of claim 17, further comprising a ring-shaped holder on a lower side of the second spray arm and coupled to the outer peripheral surface of the shaft to support the second spray arm.

19. The dishwasher of claim 17, further comprising:

a communication hole formed in the shaft to allow a portion of the washing water, which is guided by the shaft, to branch into the second spray arm.

20. A dishwasher comprises:

a tub forming a washing chamber, a sump to store washing water in the washing chamber, and a spray device in a lower portion of the tub to spray washing water to an inside of the washing chamber wherein the spray device comprising:

a shaft to guide the washing water introduced from the sump, the shaft having a truncated cone shaped in which a diameter thereof is increased as a distance to an upper portion is reduced;

a first spray blade integrally extending from an upper end of the shaft and to form a first flow path into which a portion of the washing water guided by the shaft is introduced;

a second spray blade coupled to a lower side of the first spray blade and an outer peripheral surface of the shaft, and to form a second flow path into which a remaining portion of the washing water guided by the shaft is introduced;

a holder on a lower side of the second spray blade to be coupled to the outer peripheral surface of the shaft to support the second spray blade; and a supporting tube into which the shaft and the holder are inserted to support the shaft.

21. The dishwasher of claim 20, wherein the shaft further comprises a communication hole therein to communicate with the second flow path of the second spray blade.

* * * * *